US008854203B1

(12) United States Patent
Zheng et al.

(10) Patent No.: US 8,854,203 B1
(45) Date of Patent: Oct. 7, 2014

(54) PROVIDING A DEVICE LEFT BEHIND ALERT

(75) Inventors: Lantian Zheng, San Jose, CA (US); Zhi Weng, San Jose, CA (US)

(73) Assignee: Google Inc., Mountain View, CA (US)

( * ) Notice: Subject to any disclaimer, the term of this patent is extended or adjusted under 35 U.S.C. 154(b) by 26 days.

(21) Appl. No.: 13/603,471

(22) Filed: Sep. 5, 2012

(51) Int. Cl.
*G08B 23/00* (2006.01)

(52) U.S. Cl.
USPC ..... 340/522; 340/987; 307/10.6; 455/421

(58) Field of Classification Search
None
See application file for complete search history.

(56) References Cited

U.S. PATENT DOCUMENTS

| | | | | |
|---|---|---|---|---|
| 7,613,425 | B2 | 11/2009 | Tailor | |
| 2006/0250578 | A1 | 11/2006 | Pohl et al. | |
| 2007/0037605 | A1 | 2/2007 | Logan | |
| 2007/0129113 | A1* | 6/2007 | Klicpera et al. | 455/567 |
| 2007/0259717 | A1* | 11/2007 | Mattice et al. | 463/36 |
| 2008/0268780 | A1* | 10/2008 | Werner et al. | 455/41.2 |
| 2009/0237206 | A1 | 9/2009 | Anderson | |
| 2010/0073201 | A1 | 3/2010 | Holcomb et al. | |
| 2010/0117826 | A1* | 5/2010 | Reed et al. | 340/539.32 |
| 2010/0159986 | A1* | 6/2010 | Lewis et al. | 455/557 |
| 2010/0184378 | A1* | 7/2010 | Wakefield | 455/41.2 |
| 2010/0273452 | A1* | 10/2010 | Rajann et al. | 455/411 |
| 2011/0050447 | A1* | 3/2011 | Tedesco | 340/687 |
| 2011/0263202 | A1 | 10/2011 | Lee et al. | |

* cited by examiner

*Primary Examiner* — Hai Phan
*Assistant Examiner* — Ojiako Nwugo
(74) *Attorney, Agent, or Firm* — Leydig, Voit & Mayer, Ltd.

(57) ABSTRACT

A method, non-transitory computer readable medium, and apparatus that establishes a connection between a mobile computing device and a second computing device. A notification of an initiating event is received from the second computing device. Physical movement of the mobile computing device is determined during a time period defined by the notification of the initiating event and a triggering event. An alert is output when determined physical movement is below a threshold value.

15 Claims, 3 Drawing Sheets

PROVIDING A DEVICE LEFT BEHIND ALERT

BACKGROUND

Individuals are becoming increasingly reliant on their mobile computing devices, such as cell phones, smartphones, and tablet devices, for both personal and business use. As a result, users frequently transport their mobile computing devices with them so that they can utilize them throughout the day. During use, users may have some physical separation from their mobile computing devices, such as placing them on an adjacent car seat in a car or on a desk in an office. Unfortunately, when leaving a location users may accidentally leave their mobile computing devices behind. Leaving these mobile computing devices behind may pose a number of issues, such as lost time required to return to the prior location to retrieve the mobile computing device, lost utilization of the mobile computing device, such as missing calls and messages, and potential loss or theft of the unattended mobile computing device.

SUMMARY

A method includes establishing, by a mobile computing device, a connection between the mobile computing device and a second computing device. Notification of an initiating event is received, by the mobile computing device, from the second computing device. Physical movement of the mobile computing device is determined, by the mobile computing device, during a time period defined by the notification of the initiating event and a triggering event. An alert is output, by the mobile computing device, when determined physical movement is less than a threshold value.

A non-transitory computer readable medium having stored thereon instructions for providing a device left behind alert comprising machine executable code which, when executed by a processor, causes the processor to perform steps including establishing a connection between a mobile computing device and a second computing device. Notification of an initiating event is received from the second computing device. Physical movement of the mobile computing device is determined during a time period defined by the notification of the initiating event and a triggering event. An alert is output when determined physical movement is less than a threshold value.

An apparatus comprising a memory coupled to a processor configured to execute programmed instructions stored in the memory including establishing a connection between a mobile computing device and a second computing device. Notification of an initiating event is received from the second computing device. Physical movement of the mobile computing device is determined during a time period defined by the notification of the initiating event and a triggering event. An alert is output when determined physical movement is less than a threshold value.

This technology provides a number of advantages including providing effective methods and devices for providing a device left behind alert to a user. With this technology, a mobile device user may be automatically and immediately alerted that a mobile device is about to be left behind. The alert will prevent the user from leaving the mobile device behind, saving the user time and from experiencing the inconvenience of not having the mobile device on hand. Further, the technology is cost effective as it may be adapted to provide the alert utilizing systems, such as Bluetooth and an accelerometer, which are already provided on most mobile devices.

DETAILED DESCRIPTION

Figure 1:
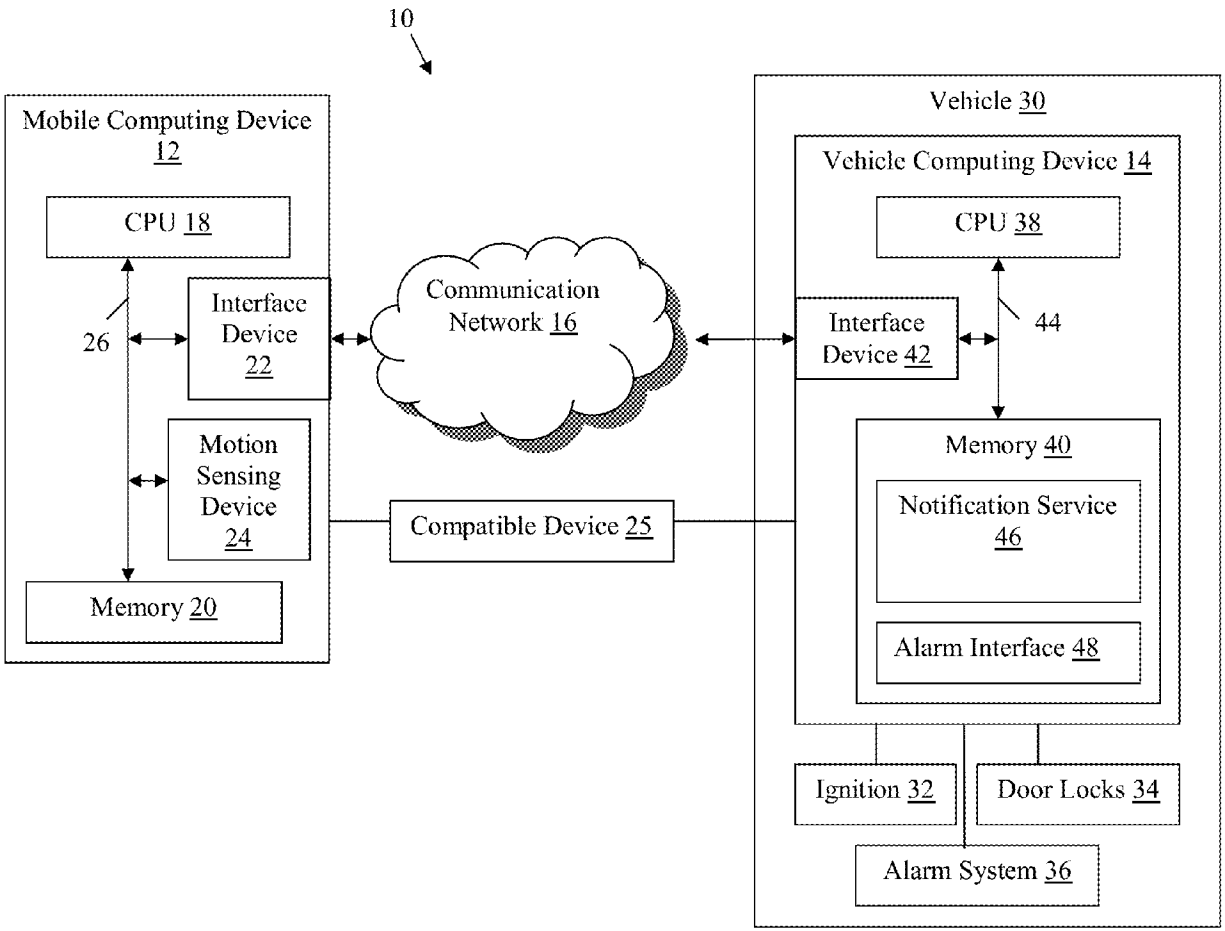
FIG. 1 is an environment with a mobile computing device connected to a vehicle computing device via a communication network to provide a device left behind alert.

An environment 10 with a mobile computing device 12 connected to a vehicle computing device 14 to provide a device left behind alert is illustrated in FIG. 1. Although the present disclosure refers to vehicle computing device 14, it is to be understood that any computing device capable of being connected to the mobile computing device may be used. By way of example only, the mobile computing device 12 may be connected to a computer in an office to provide a device left behind alert in the event that the user leaves the mobile computing device behind in the office.

The environment 10 may include the mobile computing device 12 connected to the vehicle computing device 14 via a communication network 16, although this environment can include other numbers and types of systems, devices, components, and elements connected together in other configurations with other types and numbers of communications networks. This technology provides a number of advantages including providing effective methods and devices for providing a device left behind alert to a user.

Referring more specifically to FIG. 1, the mobile computing device 12 may be a mobile and/or smart phone, although the mobile computing device can comprise other types and numbers of devices, such as a tablet computing device, PDA, minicomputer, and laptop computing device by way of example. The mobile computing device 12 may include a central processing unit (CPU) or processor 18, a memory 20, an interface device 22, and a motion sensing device 24, which are coupled together by a bus 26 or other link, although the mobile computing device 12 may contain other numbers and types of devices, components, and elements in other configurations. The processor 18 in the mobile computing device 12 may execute a program of stored instructions for one or more aspects of the present technology as described and illustrated by way of examples herein, although other types and numbers of processing devices and logic could be used and the processor 18 could execute other numbers and types of programmed instructions.

The memory 20 in the mobile computing device 12 may store the programmed instructions for one or more aspects of the present technology as described and illustrated herein, although some or all of the programmed instructions could be stored and executed elsewhere. A variety of different types of memory storage devices, such as random access memory (RAM) or a read only memory (ROM) in the system or a floppy disk, hard disk, CD ROM, DVD ROM, or other computer readable medium which is read from and written to by a magnetic, optical, or other reading and writing system that is coupled to the processor 18, can be used for the memory 20. Memory 20 in the mobile computing device 12 may store programmed instructions for performing one or more aspects of the present technology described and illustrated in more detail below.

The interface device 22 in the mobile computing device 12 may be used to operatively establish a connection and communicate between the mobile computing device 12 and the vehicle computing device 14 via the communication network 16, although other types and numbers of communication networks or systems with other types and numbers of connections and configurations can be used. By way of example only, the interface device 22 can be a Bluetooth device capable of creating a personal area network, although other devices suitable for creating a wireless network, such as a wireless local area network, mesh network, or mobile computing device network can be used.

The motion sensing device 24 can be an accelerometer although other types of devices for monitoring the motion related to a mobile computing device, such as GPS devices, gyroscope sensors or other types of motion sensors in the mobile computing device 12 can be utilized. The motion sensing device 24 communicates with the processor 18 to indicate physical movement of the mobile computing device 12.

Environment 10 may include a compatible device 25. The mobile computing device 12 may be detachably mated to the compatible device 25. The compatible device 25 may be a device charger, docking station, or USB cable, although any other compatible device capable of being detachably mated with the mobile computing device 12 may be used. The compatible device 25 may optionally allow for a direct connection between the mobile computing device 12 and the vehicle computing device 14 or other suitable computing device.

The vehicle computing device 14 may comprise any computing device capable of communicating with the mobile computing device 12 via the communication network 16. By way of example only, the vehicle computing device 14 can be an onboard vehicle computer that is in operative communication with various systems of a vehicle 30, although other devices with similar features and capabilities may be used. For example, the vehicle computing device 14 may be in operative communication with the ignition 32, the door locks 34, and the alarm system 36 of the vehicle 30, although the vehicle computing device 14 may be in operative communication with various other systems related to the vehicle 30.

The vehicle computing device 14 may include a central processing unit (CPU) or processor 38, a memory 40, and an interface device 42 which are coupled together by a bus 44 or other link, although other numbers and types of systems, devices, components, and elements in other configurations and locations can be used. The processor 38 in the vehicle computing device 14 executes a program of stored instructions for one or more aspects of the present technology as described and illustrated by way of examples herein, although other types and numbers of processing devices and logic could be used and the processor 38 could execute other numbers and types of programmed instructions.

The memory 40 in the vehicle computing device 14 may store the programmed instructions for one or more aspects of the present technology as described and illustrated herein, although some or all of the programmed instructions could be stored and executed elsewhere. By way of example only, the memory 40 can store programmed instructions for a notification service 46 and an alarm interface 48, although the memory 40 may store other types of programmed instructions. A variety of different types of memory storage devices, such as random access memory (RAM) or a read only memory (ROM) in the system or a floppy disk, hard disk, CD ROM, DVD ROM, or other computer readable medium which is read from and written to by a magnetic, optical, or other reading and writing system that is coupled to the processor 38, can be used for the memory 40.

The notification service 46 stored in the memory 40 of the vehicle computing device 14 may provide notification to the mobile computing device 12 of events related to systems of the vehicle 30, such as the ignition 32, the door locks 34, and the alarm system 36, as monitored by the vehicle computing device 14, although the notification service 46 may provide notification to the mobile computing device 12 of events related to other systems of the vehicle 30. For example, the notification service 46 may provide notification to the mobile computing device 12 when the ignition 32 is turned off or when the door locks 34 are engaged. The alarm interface 48 stored in the memory 40 of the vehicle computing device 14 may allow the mobile computing device 12 to initiate the alarm system 36 of the vehicle 30 directly.

The interface device 42 in the vehicle computing device 14 may be used to establish a connection and communicate between the vehicle computing device 14 and the mobile computing device 12 via the communication network 16, although other types and numbers of communication networks or systems with other types and numbers of connections and configurations can be used. By way of example only, the interface device 42 may utilize a Bluetooth device to pair and communicate with other devices, although other interface systems suitable for creating a connection, such as a wireless local area network or a mesh network could be used.

Although examples of the mobile computing device 12 and the vehicle computing device 14 which are connected via the communication network 16 are described herein, each of these systems can be implemented on any suitable computer system or computing device. It is to be understood that the devices and systems of the examples described herein are examples, as many variations of the specific hardware and software used to implement the examples are possible, as will be appreciated by those skilled in the relevant art(s).

The disclosed technology may also be embodied as a non-transitory computer readable medium having instructions stored thereon for one or more aspects of the present technology as described and illustrated by way of the examples herein, which when executed by a processor, cause the processor to carry out the steps necessary to implement the methods of the examples, as described and illustrated herein.

Figure 2:
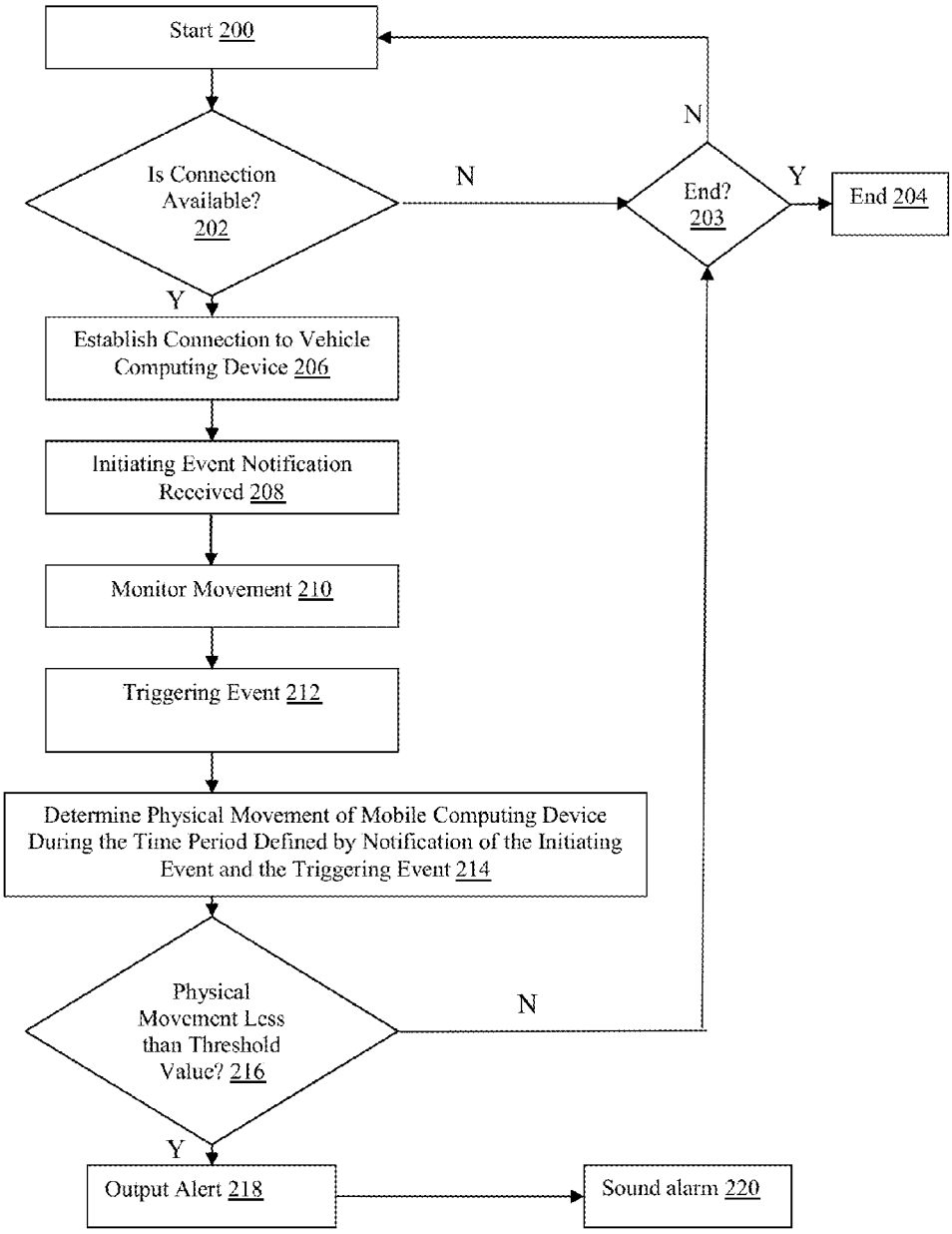
FIG. 2 is flow chart of a method for providing a device left behind alert.

A method for providing a device left behind alert will now be described with reference to FIGS. 1-2. At step 200, the method for providing a device left behind alert may be initiated by the mobile computing device 12.

At step 202, the mobile computing device 12 may determine whether it can establish a connection with the vehicle computing device 14. The vehicle computing device 14 may be available for connection when the mobile computing device 12 is brought within a sufficient proximity of the vehicle computing device 14 to form the communication network 16. By way of example only, if both the mobile computing device 12 and the vehicle computing device 14 have Bluetooth, a personal area network can automatically be formed between the two devices when the mobile computing device 12 is brought into the vehicle 30 in which the vehicle computing device 14 is located, although other types of network connections, such as a direct connection using the optional compatible device 25, such as a USB cable, can be used. If in step 202, the mobile computing device 12 determines it is unable to establish a connection with the vehicle computing device 14, then the No branch is taken to step 203.

At step 203, the mobile computing device 12 may determine whether to end the process. For example, the mobile computing device 12 may determine to end the process if the mobile computing device 12 is unable to establish a connection with the vehicle computing device 14 after a stored period of time, although other manners for ending the process could be used. If in step 203, the mobile computing device 12 determines to end the process, then the Yes branch is taken to step 204 where this method ends. If in step 203, the mobile computing device 12 determines not to end the process, then the No branch is taken back to step 200 where this process is again initiated as described earlier.

If back in step 202, the mobile computing device 12 determines it can establish a connection with the vehicle computing device 14, then the Yes branch is taken to step 206. In step 206, the mobile computing device 12 operatively establishes a connection with the vehicle computing device 14, although other manners for coupling the mobile computing device 12 into communication with the vehicle computing device 14 or another suitable computing device could be used.

At step 208, the notification service 46 of the vehicle computing device 14 may provide and the mobile computing device 12 may receive notification of an initiating event. The initiating event may be associated with the vehicle computing device 14, although other suitable initiating events not associated with the vehicle computing device 14 may be used. In this example, the initiating event is when the ignition 32 of the vehicle 30 is turned off, although other events associated with the vehicle computing device 14 or other computing devices connected to the mobile computing device could be used as the initiating event. When the ignition 32 of the vehicle 30 is turned off, the notification service 46 of the vehicle computing device 14 is configured to provide a notification of the occurrence of this initiating event to the mobile computing device 12 connected to the vehicle computing device 14, although other methods of receiving notification of the initiating event may be used.

After receipt of the notification of the initiating event at step 208, at step 210, physical movement of the mobile computing device 12 may be monitored. The physical movement of the mobile computing device 12 may be monitored using the motion sensing device 24, such as an accelerometer, starting at the time of the receipt of the notification of the initiating event, although other manners for monitoring the movement of the mobile computing device 12 can be used.

At step 212, the notification service 46 of the vehicle computing device 14 may provide notification of a triggering event. The triggering event may be associated with the vehicle computing device 14. Alternatively, the triggering event may be an event not associated with the vehicle computing device 14, such as a lapse of time following the initiating event. In this example, the triggering event may be the door locks 34 of the vehicle 30 being locked, although other types and numbers of triggering events may be utilized. When the door locks 34 of the vehicle 30 are locked, the notification service 46 of the vehicle computing device 14 is configured to provide a notification of the occurrence of the triggering event to the mobile computing device 12 connected to the vehicle computing device 14 via communication network 16, although other methods of determining that the triggering event has occurred may be used.

At step 214, the mobile computing device 12 may determine the physical movement of the mobile computing device 12 during the time period defined by notification of the initiating event and the triggering event. For example, the mobile computing device 12 may determine physical movement using the motion sensing device 24, such as an accelerometer, although other methods of determining physical movement of the mobile computing device 12 may be used.

In step 216, the mobile computing device 12 determines whether the physical movement of the mobile computing device 12 is less than a threshold value, such as a stored distance which would indicate the mobile computing device 12 is still within the dimensions of the vehicle 30. The threshold distance may be modified to ensure the user has removed the mobile computing device 12 from the vehicle 30. If at step 216, the physical movement of the mobile computing device 12 is not less than the threshold value, the No branch is taken to step 203 where the mobile computing device 12 may determine whether to end the process. For example, the mobile computing device 12 may determine to end the process if the mobile computing device 12 remains inactive for a stored period of time, although other manners for ending the process could be used. If in step 203, the mobile computing device 12 determines to end the process, then the Yes branch is taken to step 204 where this method ends. If in step 203, the mobile computing device 12 determines not to end the process, then the No branch is taken back to step 200 where this process is again initiated as described earlier.

If in step 216, the mobile computing device 12 determines the physical movement of the mobile computing device 12 is less than a threshold value, then the Yes branch is taken to step 218. For example, the mobile computing device 12 may determine the mobile computing device 12 has physical movement less than a stored threshold distance, although other methods of determining the mobile computing device 12 has physical movement less than a threshold value may be used.

At step 218, the mobile computing device 12 outputs an alert to the vehicle computing device 14, although other manners for outputting an alert could be used, such as the mobile computing device 12 emitting an audible sound, such as a selected phone ring tone, the mobile computing device 12 vibrating, or a combination of sound and vibration. At step 220, the vehicle computing device 14 receives the alert and triggers the alarm system 36 in the vehicle 30 to output an audible alarm, although other types and numbers of alerts, such as flashing lights, may be used.

Figure 3:
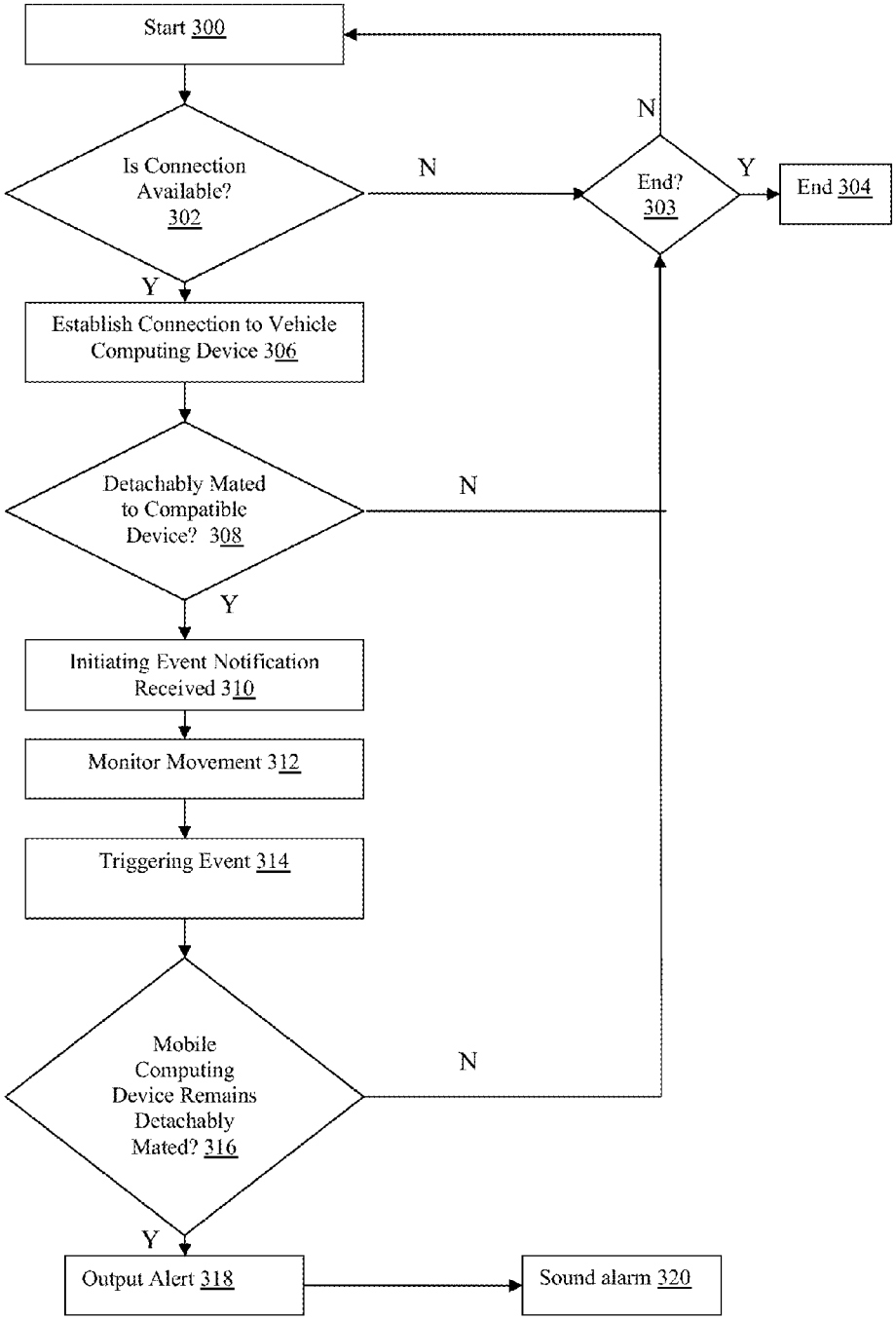
FIG. 3 is a flow chart of another method for providing a device left behind alert.

An alternative method for providing a device left behind alert will now be described with reference to FIGS. 1 and 3. At step 300, the method for providing a device left behind alert may be initiated by the mobile computing device 12.

At step 302, the mobile computing device 12 may determine whether it can establish a connection with the vehicle computing device 14. The vehicle computing device 14 may be available for connection when the mobile computing device 12 is brought within a sufficient proximity of the vehicle computing device 14 to form the communication network 16. By way of example only, if both the mobile computing device 12 and the vehicle computing device 14 have Bluetooth, a personal area network can automatically be formed between the two devices when the mobile computing device 12 is brought into the vehicle 30 in which the vehicle computing device 14 is located, although other types of network connections, such as a direct connection using the optional compatible device 25, such as a USB cable, can be used. If in step 302, the mobile computing device 12 determines it is unable to establish a connection with the vehicle computing device 14, then the No branch is taken to step 303.

At step 303, the mobile computing device 12 may determine whether to end the process. For example, the mobile computing device 12 may determine to end the process if the mobile computing device 12 is unable to establish a connection with the vehicle computing device 14 after a stored period of time, although other manners for ending the process could be used. If in step 303, the mobile computing device 12 determines to end the process, then the Yes branch is taken to step 304 where this method ends. If in step 303, the mobile computing device 12 determines not to end the process, then the No branch is taken back to step 300 where this process is again initiated as described earlier.

If back in step 302, the mobile computing device 12 determines it can establish a connection with the vehicle computing device 14, then the Yes branch is taken to step 306. In step 306, the mobile computing device 12 operatively establishes a connection with the vehicle computing device 14, although other manners for coupling the mobile computing device 12 into communication with the vehicle computing device 14 or another suitable computing device could be used.

At step 308, the mobile computing device 12 may determine whether the mobile computing device 12 is detachably mated to the compatible device 25. If in step 308 the mobile computing device 12 determines the mobile computing device 12 is not detachably mated to the compatible device 25, then the No branch is taken to step 303. At step 303, the mobile computing device 12 may determine whether to end the process. For example, the mobile computing device 12 may determine to end the process if the mobile computing device 12 remains inactive for a stored period of time. If in step 303, the mobile computing device 12 determines to end the process, then the Yes branch is taken to step 304 where this method ends. If in step 303, the mobile computing device 12 determines not to end the process, then the No branch is taken to step 310.

At step 310, the mobile computing device 12 may receive notification of an initiating event. The initiating event may be associated with the vehicle computing device 14 or other suitable computing device, although other initiating events not associated with the vehicle computing device 14 may be used. In this example, the initiating event is when vehicle computing device 14 is turned off, although other events associated with the vehicle computing device 14 or other computing devices connected to the mobile computing device, such as the computing device entering a mode indicating the device will not be used for a period of time, such as the screen of the device being locked, could be used as the initiating event. When the vehicle computing device 14 is turned off, the vehicle computing device 14 is configured to provide a notification of the occurrence of this initiating event to the mobile computing device 12 connected to the vehicle computing device 14, although other methods of receiving notification of the initiating event may be used.

After receipt of the notification of the initiating event at step 310, at step 312, physical movement of the mobile computing device 12 may be monitored. The physical movement of the mobile computing device 12 may be monitored by determining whether the mobile computing device 12 remains detachably mated to the compatible device 25, although other manners for monitoring the movement of the mobile computing device 12 can be used.

At step 314, the mobile computing device 12 may receive notification of a triggering event. The triggering event may be associated with the vehicle computing device 14. Alternatively, the triggering event may be an event not associated with the vehicle computing device 14. In this example, the triggering event may be a lapse of time following the initiating event, although other types and numbers of triggering events may be utilized.

At step 316, the mobile computing device 12 may determine the whether the mobile computing device 12 remained detachably mated to the compatible device 25 during the time period defined by notification of the initiating event and the triggering event. If at step 316, the mobile computing device 12 does not remain detachably mated to the compatible device 25, the No branch is taken to step 303 where the mobile computing device 12 may determine whether to end the process. For example, the mobile computing device 12 may determine to end the process if the mobile computing device 12 remains inactive for a stored period of time, although other manners for ending the process could be used. If in step 303, the mobile computing device 12 determines to end the process, then the Yes branch is taken to step 304 where this method ends. If in step 303, the mobile computing device 12 determines not to end the process, then the No branch is taken back to step 300 where this process is again initiated as described earlier.

If in step 316, the mobile computing device 12 remains detachably mated to the compatible device 25, then the Yes branch is taken to step 318. At step 318, the mobile computing device 12 outputs an alert to the vehicle computing device 14, although other manners for outputting an alert could be used, such as the mobile computing device 12 emitting an audible sound, such as a selected phone ring tone, the mobile computing device 12 vibrating, or a combination of sound and vibration. At step 320, the vehicle computing device 14 receives the alert and triggers the alarm system 36 in the vehicle 30 to output an audible alarm, although other types and numbers of alerts, such as flashing lights, may be used.

Accordingly, as illustrated and described with reference to the examples herein, this technology provides a number of advantages including providing effective methods and devices for providing a device left behind alert to a user. With this technology, a mobile device user may be automatically and immediately alerted that a mobile device is about to be left behind. The alert will prevent the user from leaving the mobile device behind, saving the user time and from experiencing the inconvenience of not having the mobile device on hand. Further, the technology is cost effective as it may be adapted to provide the alert using systems such as Bluetooth and an accelerometer, which are already provided on most mobile devices.

It will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the disclosure. Additionally, the recited order of processing elements or sequences, or the use of numbers, letters, or other designations therefore, is not intended to limit the claimed processes to any order except as may be specified in the claims. Accordingly, the disclosure is limited only by the following claims and equivalents thereto.

What is claimed is:

1. A method comprising:

establishing, by a mobile computing device, a wireless connection between the mobile computing device and a second computing device;

receiving, by the mobile computing device from the second computing device via the wireless connection, a notification of an initiating event;

determining, by a processor included in the mobile computing device and based on information provided by a motion-sensing device included in the mobile computing device, physical movement of the mobile computing device during a time period defined by the notification of the initiating event and a triggering event; and responsive to determining that the physical movement of the mobile computing device during the time period defined by the notification of the initiating event and the triggering event is less than a threshold value, outputting, by the mobile computing device, an alert, wherein the second computing device is a vehicle computing device in a vehicle, the initiating event is a turning off of the vehicle, and the triggering event is a locking of a vehicle door of the vehicle.

2. The method of claim 1, further comprising transmitting, by the mobile computing device, to the second computing device, the alert, such that the second computing device outputs the alert.

3. The method of claim 1, wherein the alert as output as an audible sound.

4. The method of claim 1, wherein the determining further comprises determining, by the mobile computing device, the physical movement of the mobile computing device using an accelerometer in the mobile computing device.

5. The method of claim 1, wherein the mobile computing device is detachably mated with a compatible device prior to the initiating event and the determined physical movement of the mobile computing is less than a threshold value when the mobile computing device remains detachably mated to the compatible device.

6. A non-transitory computer readable medium having stored thereon instructions for providing a device left behind alert comprising machine executable code which, when executed by a processor, causes the processor to perform steps comprising:

establishing a wireless connection between a mobile computing device and a second computing device;

receiving, from the second computing device via the wireless connection, a notification of an initiating event;

determining, based on information provided by a motion-sensing device included in the mobile computing device, physical movement of the mobile computing device during a time period defined by the notification of the initiating event and a triggering event; and responsive to determining that the physical movement of the mobile computing device during the time period defined by the notification of the initiating event and a triggering event is less than a threshold value, outputting an alert, wherein the second computing device is a vehicle computing device in a vehicle, the initiating event is a turning off of the vehicle, and the triggering event is a locking of a vehicle door of the vehicle.

7. The computer readable medium of claim 6, further comprising transmitting, to the second computing device, the alert, such that the second computing device outputs the alert.

8. The computer readable medium of claim 6, wherein the alert is output as an audible sound.

9. The computer readable medium of claim 6, wherein the determining further comprises determining the physical movement of the mobile computing device using an accelerometer in the mobile computing device.

10. The computer readable medium of claim 6, wherein the mobile computing device is detachably mated with a compatible device prior to the initiating event and the determined physical movement of the mobile computing is less than a threshold value when the mobile computing device remains detachably mated to the compatible device.

11. An apparatus comprising;

a processor; and a memory coupled to the processor, wherein the processor is configured to execute programmed instructions stored in the memory to perform the steps of:

establishing a wireless connection between a mobile computing device and a second computing device;

receiving, from the second computing device via the wireless connection, a notification of an initiating event;

determining, based on information provided by a motion sensing device included in the mobile computing device, physical movement of the mobile computing device during a time period defined by the notification of the initiating event and a triggering event; and responsive to determining that the physical movement of the mobile computing device during the time period defined by the notification of the initiating event and the triggering event is less than a threshold value, outputting an alert, wherein the second computing device is a vehicle computing device in a vehicle, the initiating event is a turning off of the vehicle, and the triggering event is a locking of a vehicle door of the vehicle.

12. The apparatus of claim 11, wherein the steps further comprise: transmitting, to the second computing device, the alert, such that the second computing device outputs the alert.

13. The apparatus of claim 11, wherein the alert is output as an audible sound.

14. The apparatus of claim 11, wherein the determining further comprises determining the physical movement of the mobile computing device using an accelerometer in the mobile computing device.

15. The apparatus of claim 11, wherein the mobile computing device is detachably mated with a compatible device prior to the initiating event and the determined physical movement of the mobile computing is less than a threshold value when the mobile computing device remains detachably mated to the compatible device.

* * * * *